US007896349B2

(12) United States Patent
Pershin et al.

(10) Patent No.: US 7,896,349 B2
(45) Date of Patent: Mar. 1, 2011

(54) RING AND HOOK GAME APPARATUS

(76) Inventors: Jeremy Christopher Pershin, Denver, CO (US); Jeffery Michael Pershin, Lakewood, CO (US); Joseph T. Pershin, Littleton, CO (US)

( * ) Notice: Subject to any disclaimer, the term of this patent is extended or adjusted under 35 U.S.C. 154(b) by 238 days.

(21) Appl. No.: 12/031,349

(22) Filed: Feb. 14, 2008

(65) Prior Publication Data

US 2009/0206550 A1 Aug. 20, 2009

(51) Int. Cl.
*A63B 67/06* (2006.01)

(52) U.S. Cl. ..... 273/332

(58) Field of Classification Search ..... 273/331, 273/332, 334, 335; D21/304
See application file for complete search history.

(56) References Cited

U.S. PATENT DOCUMENTS

| | | | | | |
|---|---|---|---|---|---|
| 117,780 | A | * | 8/1871 | Hoyt | 273/332 |
| 292,899 | A | * | 2/1884 | Davies | 273/332 |
| 1,052,907 | A | * | 2/1913 | Fergusson | 273/332 |
| 1,121,353 | A | * | 12/1914 | Grikscheit | 273/332 |
| 1,398,511 | A | * | 11/1921 | Hanrath | 273/332 |
| 2,942,886 | A | * | 6/1960 | Ackerman | 273/332 |
| 2,950,917 | A | * | 8/1960 | Lyon | 273/332 |
| 2,950,918 | A | * | 8/1960 | Lyon | 273/332 |
| 2,991,034 | A | * | 7/1961 | Lyon | 248/121 |
| 3,009,702 | A | * | 11/1961 | Lyon | 273/332 |
| 3,017,185 | A | | 1/1962 | Marshall | |
| 3,232,285 | A | | 2/1966 | Rasner | |
| 3,520,535 | A | * | 7/1970 | Mcglade et al. | 273/332 |
| 4,120,498 | A | | 10/1978 | Mutschler et al. | |
| D257,745 | S | | 12/1980 | Abraham | |
| D266,013 | S | | 8/1982 | Perry et al. | |
| 4,477,719 | A | | 10/1984 | Watterson | |
| 4,564,200 | A | | 1/1986 | Loring et al. | |
| D285,811 | S | | 9/1986 | Donahoe | |
| 4,635,942 | A | | 1/1987 | Flaherty, Jr. | |
| D288,828 | S | | 3/1987 | Romestan et al. | |
| 5,171,019 | A | | 12/1992 | Arnette | |
| 5,265,885 | A | | 11/1993 | Blount | |
| D370,032 | S | | 5/1996 | Bidwell et al. | |
| 5,709,604 | A | | 1/1998 | Coats et al. | |
| 5,961,384 | A | | 10/1999 | Robinson | |
| D423,057 | S | | 4/2000 | Mooney | |
| 6,543,768 | B1 | | 4/2003 | Kuzel | |
| 2006/0189370 | A1 | | 8/2006 | Baerlocher et al. | |
| 2006/0214376 | A1 | | 9/2006 | Weller | |
| 2009/0206550 | A1 | * | 8/2009 | Pershin et al. | 273/332 |

* cited by examiner

*Primary Examiner* — Raleigh W. Chiu
(74) *Attorney, Agent, or Firm* — Roger A. Jackson

(57) ABSTRACT

A hook and ring game apparatus and method includes a hook device having a mounting portion with a longitudinal axis substantially transverse to a surface. The hook device further including an arcuate portion extending from the mounting portion forming a sweep of about one-hundred and eighty degrees terminating in a cantilever beam having an acute angle to the surface. Further included is a ring assembly having a tether with a first end portion freely suspended from a selected position in an overhead support and a second end portion adjacent to a ring being operational to freely swing a pendulum type of movement relative to the overhead support. The ring and hook are operational to form a chance element to removably engage one another as the ring moves through the arc path potentially contacting with the hook, with either the ring removably engaging the hook or not engaging the hook.

7 Claims, 11 Drawing Sheets

RING AND HOOK GAME APPARATUS

TECHNICAL FIELD

The present invention is directed to a game wherein a ring is manually swung on a tether, with the ring having movement toward a hook, wherein the goal is to "catch" the ring upon the hook. More particularly, the present invention is a ring and hook game apparatus with a ring tethered to a cable that is pivotally connected to an overhead support or ceiling. Multiple different size hooks can be utilized, in addition to the possibility of different tether points with each different size hook having a different game-point value. The scoring method is similar to a volleyball game scoring method.

BACKGROUND OF INVENTION

It is well recognized in the prior art the benefit of playing games as an enjoyable method by which an individual can build their motor, eye/hand coordination, and mathematical skills. Most games have an element of chance and an element of competitive strategy that allows the player to win the game while utilizing a minimal amount of apparatus required to play the game. There are numerous approaches to playing games, although most of the games utilize a series of chance elements, typically being dice as the most common example of a chance element, thus the typical dice or die contains six sides, in that each of the sides normally has an indicia in the form of a letter or a particular number of dots indicating a number. The dice are then rolled by the player with the top side of the dice counting as letters or numbers that the player can utilize in an attempt to utilize the various indicated letters or numbers for some type of scoring scheme that eventually will lead to a game winner. There are many other types of chance elements such as such as horseshoes, darts, rings, and the like, wherein all of the aforementioned chance elements involve both an element of player skill and "luck" or chance in obtaining the desired score, position, or the like. The mix or ratio of skill to chance varies with the chance element, however, in any case with the more use of the chance element by the player, an increased content of skill usually is present giving the player an advantage in attempting to give the player a more desired result from the chance element.

In looking at the prior art in the chance element game area, specifically being concerned with ring type chance elements, in U.S. Pat. No. 5,171,019 to Arnette disclosed a tethered ring and hook game and kit. In Arnette, a brass ring is tethered to a ceiling by means of an eye screw mounted to the ceiling, further a ball-in-socket swivel is provided intermediate between the string and the eye screw to prevent the cord from being twisted as the ring is released toward the hook. A hook supported block in Arnette is adapted to be mounted to a wall by means of a dowel screw, Velcro fasteners, or a hook, and is mounted to the resilient (vibration dampening) block for receiving the ring, reference column 1, lines 66-69 and column 2, lines 6-17. Continuing in this area, looking at United States design Pat. No. US D288,828 to Romestan et al. disclosed is a design for a ring toss game target board having a ring tied to a string, and a target board with eleven hooks set at different game-point values. The target board in Romestan et al., is attached to a vertical board at an acute angle with the vertical board including peg holes to record player wins and losses, reference FIGS. 1 and 2. Note that in Romestan et al., there is no disclosure related to the mounting or the mounting position of the tether that supports the ring.

Yet further, in the prior art in the ring game area, in U.S. Pat. No. 4,564,200 to Loring et al. disclosed is a tethered ring game with hook configuration having a ring made of heavy material such as steel attached to a tether made of a stable and flexible material such as braided nylon cord. In Loring et al., the cord is attached to an overhead mounted pendulum base affixed to an overhead support or ceiling. The cord's length in Loring et al., is equal to the distance between the pendulum base and a wall mounted hook with the tethered ring removably engaged upon the wall mounted hook. In addition, Loring et al., modifies the standard open hook configuration by eliminating the shank and/or "goose neck" and varies the circumference of the actual circular hook portion, see in particular FIGS. 3 and 7b, with the goal of making the player skill required increase. Loring et al., has optionally the hook being mounted on the free end of an arm with the other end mounted to a shaft of a motor having a counterclockwise rotation with play being begun by starting the motor and timing the pendulous action of the ring to snare the hook to add a new challenge (by having the hook in motion) to landing or removably engaging the ring upon the hook, see FIG. 5. Further, in Loring et al., the counterclockwise rotation of the arm will disengage the ring and put it back in play, reference column 2, lines 18-26, lines 35-39, and lines 41-45.

Continuing, in the prior art for ring toss games, in looking at United States Design Pat. No. US D423,057 to Mooney that discloses a ring that is suspended upon a tether from an overhead support being removably engaged to a wall mounted hook, as this is a design patent there is no functional teaching other than what is disclosed in the Figures, thus there is no disclosure related to tether support position relative to the wall mounted hook, or the size and configuration of the ring and hook themselves. Continuing, in this same area of hook and ring game prior art and being similar to Romestan et al., in United States design Pat. No. US D285,811 to Donahoe disclosed is a tethered ring and hook game that is self contained including an integral vertical support for the hook board and an overhead support for the ring tether. Donahoe's hook board is similar in appearance to Romestan et al., by having a board face at an acute angle to the vertical support with a plurality of randomly positioned hooks. Further, in the design patent prior art area for hook and ring games, in United States design Pat. No. US D266,013 to Perry et al., that again with Perry et al., being a design patent, there is no teaching related to tether and ring positioning and the associated skill levels, being merely a pictorial representation of a tethered ring and a hook on a common structure.

Further, in the prior art for hook and ring games that are different versions of the aforementioned hook and ring games, in U.S. Pat. No. 4,120,498 to Mutschler et al., disclosed is a self contained hook and ring game that has a tether suspended form an overhead support wherein the ring has an extension rod or beam (or termed "second target rod 48") from the outer ring circumference with the ring swinging on the tether in an attempt to engagably land on a plurality of hooks that are randomly mounted positionally on a vertical pole. This extension rod in Mutschler et al., has the effect of increasing the difficulty of engaging the ring upon the hook by acting as a blocking element to prevent other hook members from impalation of the ring, in addition the extension also can cause an uneven (unbalanced) flight path of the ring, further increasing the difficulty of engaging the ring upon the hook during the player throw of the ring.

Other options, in this area include scoring assistance components, such as electronic buzzers, lights, and the like, in looking at U.S. Pat. No. 4,635,942 to Flaherty, Jr. a ring and hook game is disclosed that utilizes a pair of hooks that a ring randomly removably engages, wherein the ring being engaged to the pair of hooks facilitates a closed electrical circuit as between the pair of hooks that that activates a light and a buzzer for scoring purposes. In Flaherty, Jr. as far as the tether and ring mounting on an overhead support and the hooks being positioned as against a vertical support, this hook and ring game is fairly conventional. Furthermore, in Flaherty, Jr. there is no teaching relative to positioning of the tether, ring or hooks in relation to the skill level required for playing of the game. Another prior art example for a hook and ring game with the enhancement of automated scoring apparatus is in U.S. Pat. No. 5,709,604 to Coats et al., that discloses a self contained hook and ring game in the form of an arcade type game apparatus. In Coats et al., there is some level of sophisticated scoring logic utilizing hardware and software for scoring multiple players, display of scores, having capability for coin operation for pay for play function. Further in Coats et al., there is a skill varying option to reposition the hook rotationally as against the vertical board, i.e. as being vertically upright (hook open side being upright), or the hook open side facing laterally outward, and also with the hook open side facing downward, or even with the hook continuously rotating, with the hook open end operating through a three hundred and sixty degree circumferential arc for the highest level of player difficulty, being somewhat similar to Loring et al, for the operation of hook movement, although Loring et al., optionally rotates the hook through a large radius arc, wherein Coats et al., optionally rotates the hook about its shank longitudinal axis.

What is needed is a game that allows a higher proportion of player strategy and options as opposed to the prior art concentrating mostly on player chance by typically initiating a chance element into motion and hoping for the best result. A number of the cited references abruptly change the playing game difficulty by initiating some structural change to a singular new higher level of difficulty, such as moving the hook to increase difficulty in scoring or engaging the ring upon the hook, as in Loring et al., and Coats et al., or by adding obfuscating structure to the ring to increase difficulty as in Mutschler et al., Only Coats et al., offers some incremental difficulty increase adjustment with the hook opening being right side up, the hook open on the side, or the hook open on the bottom for setting varying levels of difficulty in engaging the ring on the hook. Outside of the prior art hook and ring games controlling to some extent the chance element (or difficulty of engaging the ring upon the hook), via positioning of the hook rotationally or adding structure to the ring, there is little taught on the positioning of the ring tether in relation to the hook position, wherein without controlling this positioning there will be a large degree of variance in game playing engagements of the ring upon the hook and thus in difficulty level of scoring in the game. Thus, there needs to be a hook and ring game that gives criterion for the ring tethering position in relation to the hook, along with incremental adjustments possible for the hook for instance that would allow a player to "fine tune" the game difficulty level to a large number of desired levels of challenge, and that way the game would have a more controlled ability level to successfully engage the ring and the hook for all skill levels to enjoy.

SUMMARY OF INVENTION

Broadly, the present invention is a hook and ring game apparatus that includes a hook device having a mounting portion with a proximal end portion and a distal end portion having a longitudinal axis spanning there-between that is positioned substantially transverse to a surface. Wherein the proximal end portion extends from the surface forming a proximal end portion and a surface interface, the hook device further including an arcuate portion extending from the distal end portion wherein the arcuate portion forms a sweep of about one-hundred and eighty (180) degrees terminating in a cantilever beam having a lengthwise axis. The cantilever beam approximately extending to the distal end portion, with the lengthwise axis forming an acute angle in relation to the surface, wherein the acute angle is adjacent to the surface interface.

Further included in the hook and ring game apparatus is a ring assembly having a flexible tether extension with a first end portion and a second end portion resulting in a defined length of the tether extension there-between, with the tether having an extension axis, the tether extension first end portion is freely suspended from a selected position in an overhead support. The tether extension second end portion is adjacent to a ring, forming a ring assembly that is operational to freely swing the ring through a pendulum type arc path of movement relative to the overhead support. The overhead support is placed in a selected position such that the extension length and ring further define a greater combined ring assembly length that spans from the hook proximal portion and surface interface to the selected position of the overhead support. The ring and hook are operational to form a chance element to removably engage one another as the ring moves through the arc path potentially coming into contact with the hook, with either the ring removably engaging the hook or not engaging the hook, wherein the ring will follow the arc path in a substantially reverse direction.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
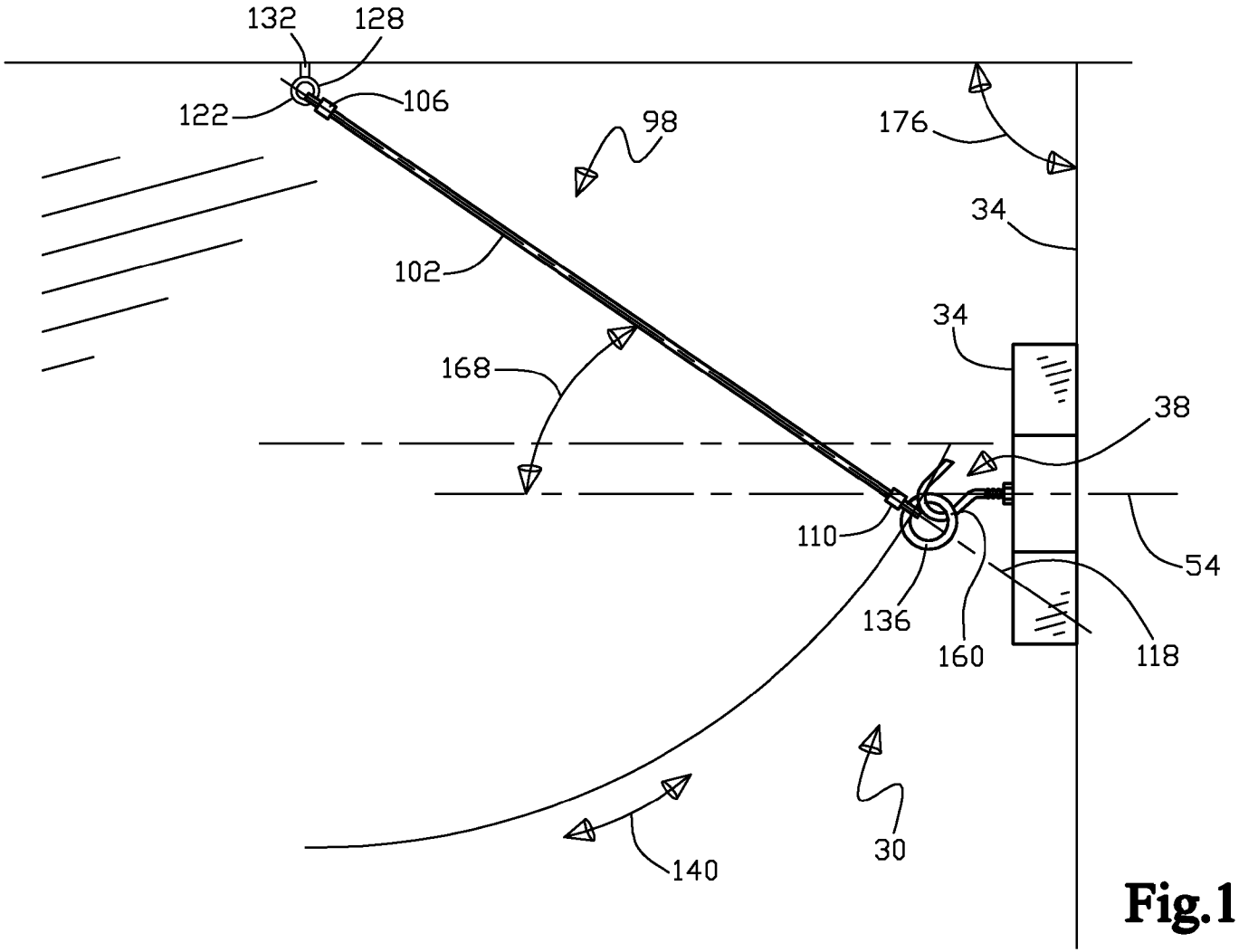
FIG. 1 shows a side elevation view of the hook and ring game apparatus, wherein the ring has passed through a pendulum type movement on the tether with the ring engaged on the hook indicating a score.

30 Hook and ring game apparatus
34 Surface
38 Hook device
42 Mounting portion for hook device 38
46 Proximal end portion of mounting portion 42
50 Distal end portion of mounting portion 42
54 Longitudinal axis of mounting portion 42
58 Interface between the proximal end portion 46 and the surface 34
62 Transverse positioning of longitudinal axis 54 to the surface 34
66 Arcuate portion of the hook device 38
70 Sweep of arcuate portion 66
74 Cantilever beam
78 Lengthwise axis of cantilever beam 74
82 Acute angle between the lengthwise axis 78 and the surface 34
86 Contiguous pattern positioning of the plurality of adjacently placed hook devices 38
90 Radius of arcuate portion 66 of hook device 38
94 Selectable length of the mounting portion 42
98 Ring assembly
102 Flexible tether extension
106 First end portion of flexible tether extension 102
110 Second end portion of flexible tether extension 102
114 Defined length of tether extension
118 Extension axis of tether extension
122 Free suspension of flexible tether extension 102
128 Selected position of the extension first end portion 106
132 Overhead support
136 Ring
140 Freely swinging of ring assembly 98
144 Pendulum type arc path of movement of ring assembly 98
148 Lateral pendulum type arc path of movement of ring assembly 98
152 Length of combined ring assembly 98
156 Span from hook proximal portion 46 and surface 34 interface 58 to the selected position 128 of the overhead support 132
160 Removable engagement of the ring 136 and the hook 38
164 Reverse direction of movement for the pendulum arc path 144 or 148
168 Angular relation between the extension axis 118 and the longitudinal axis 54
172 Adjacent positioning of the plurality of hook devices 38
176 Approximately perpendicular relationship between the overhead support 132 and the surface 34
180 Player
184 Grasping of ring by player 180
188 Releasing of ring by player 180
190 Floor
192 Distance of player 180 to surface 34
196 Height of hook 38 above floor 190

DETAILED DESCRIPTION

Figure 2:
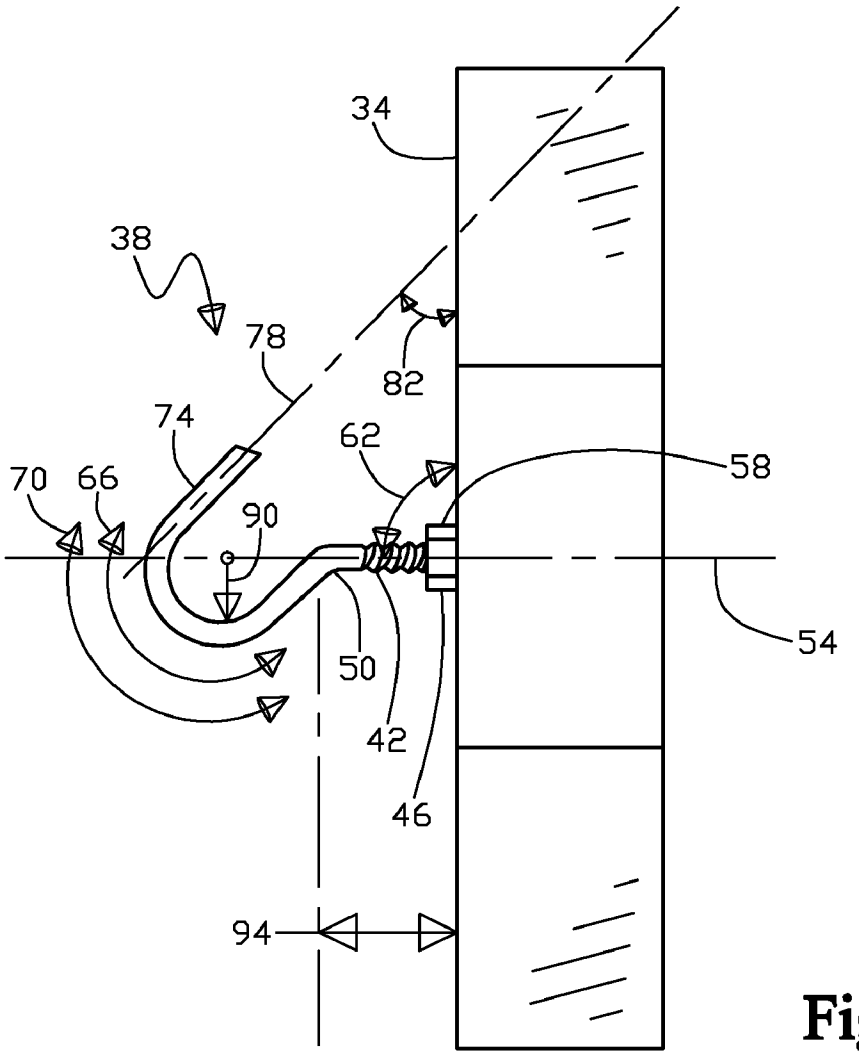
FIG. 2 shows a side elevation view of the hook adjacent to the surface with particulars of the hook, such as the hook selectable length extension, the hook radius, the hook arcuate section, and the hook cantilever portion.
Figure 3:
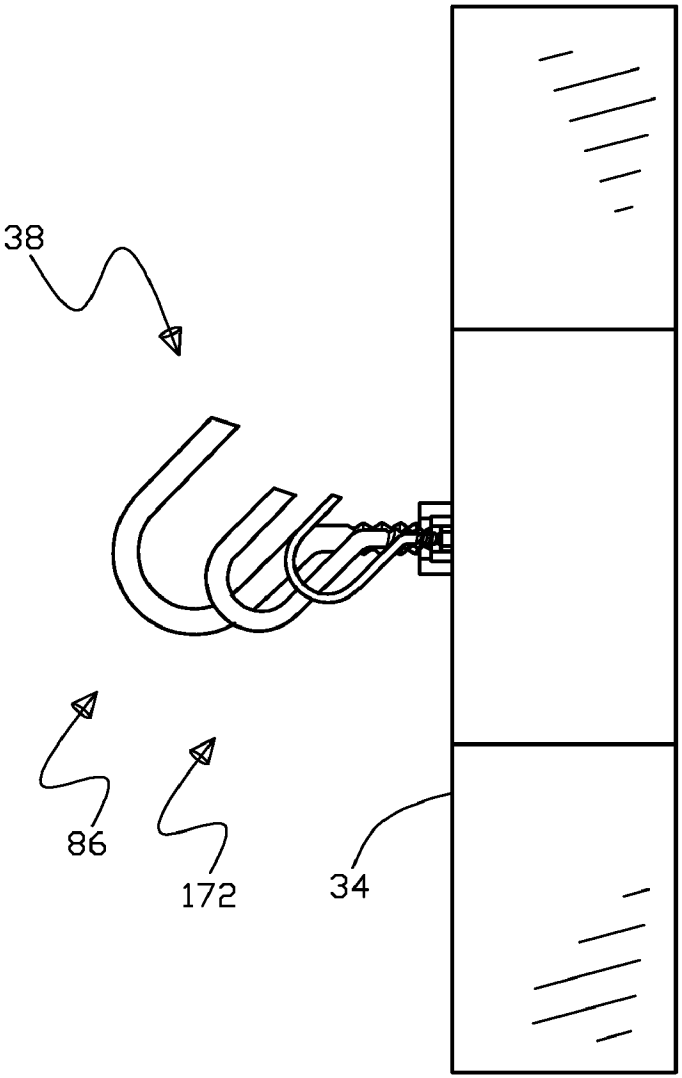
FIG. 3 shows a side elevation view of a plurality of hooks adjacent to the surface somewhat similar to the single hook in FIG. 2.
Figure 4:
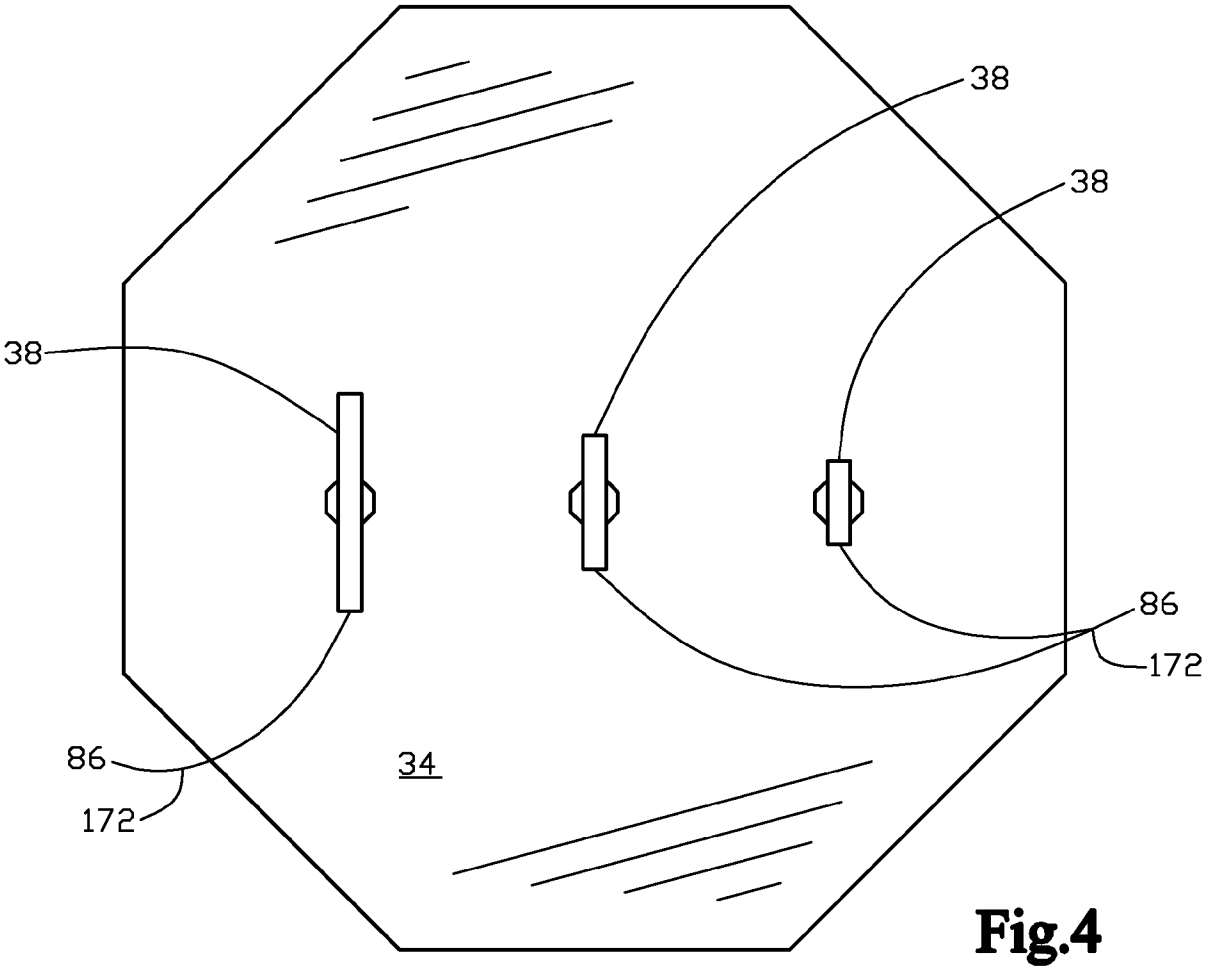
FIG. 4 shows an end view of the surface with the plurality of hooks, basically being the end view of FIG. 3.
Figure 5:
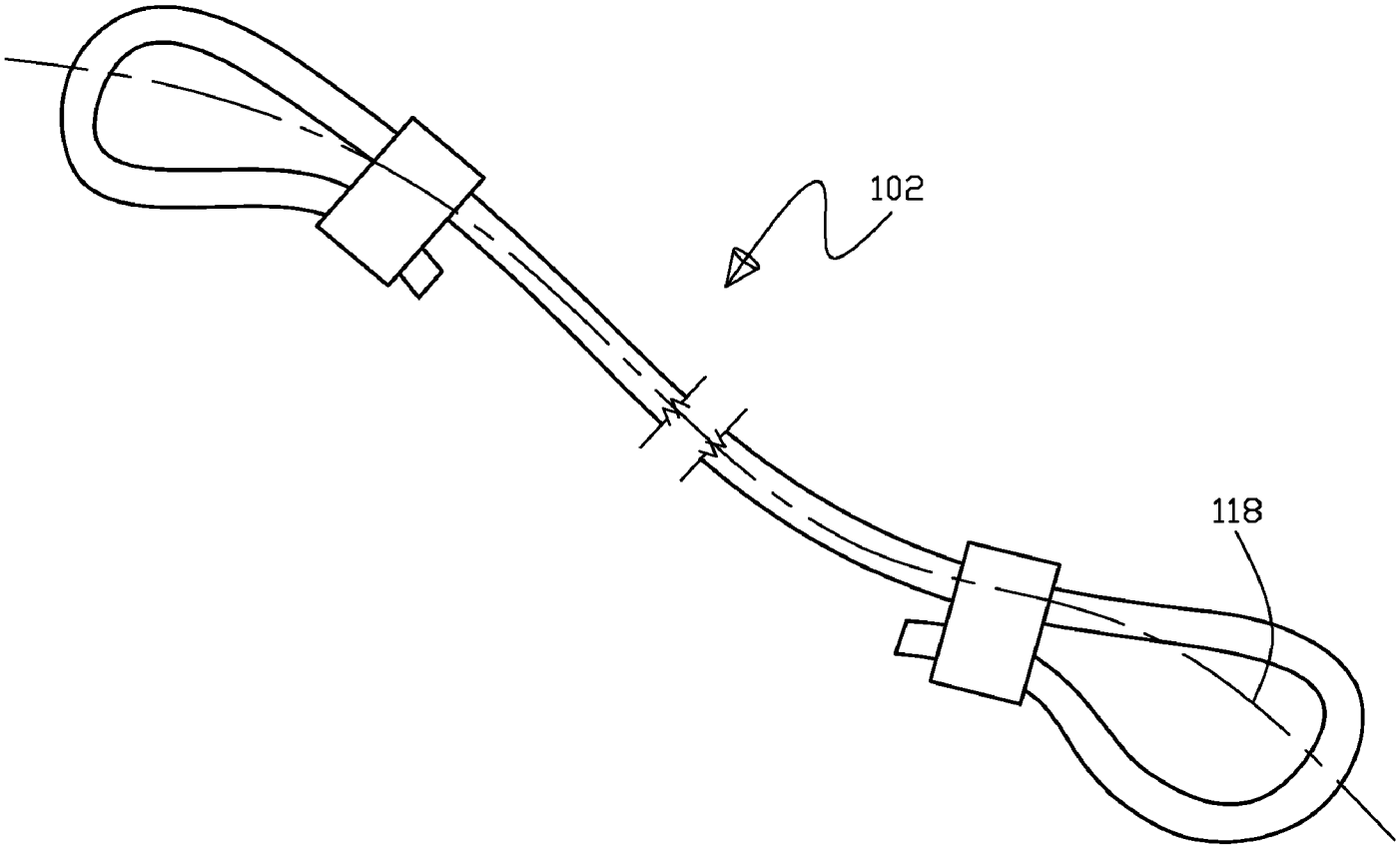
FIG. 5 shows a side elevation view of the tether extension assembly.
Figure 6:
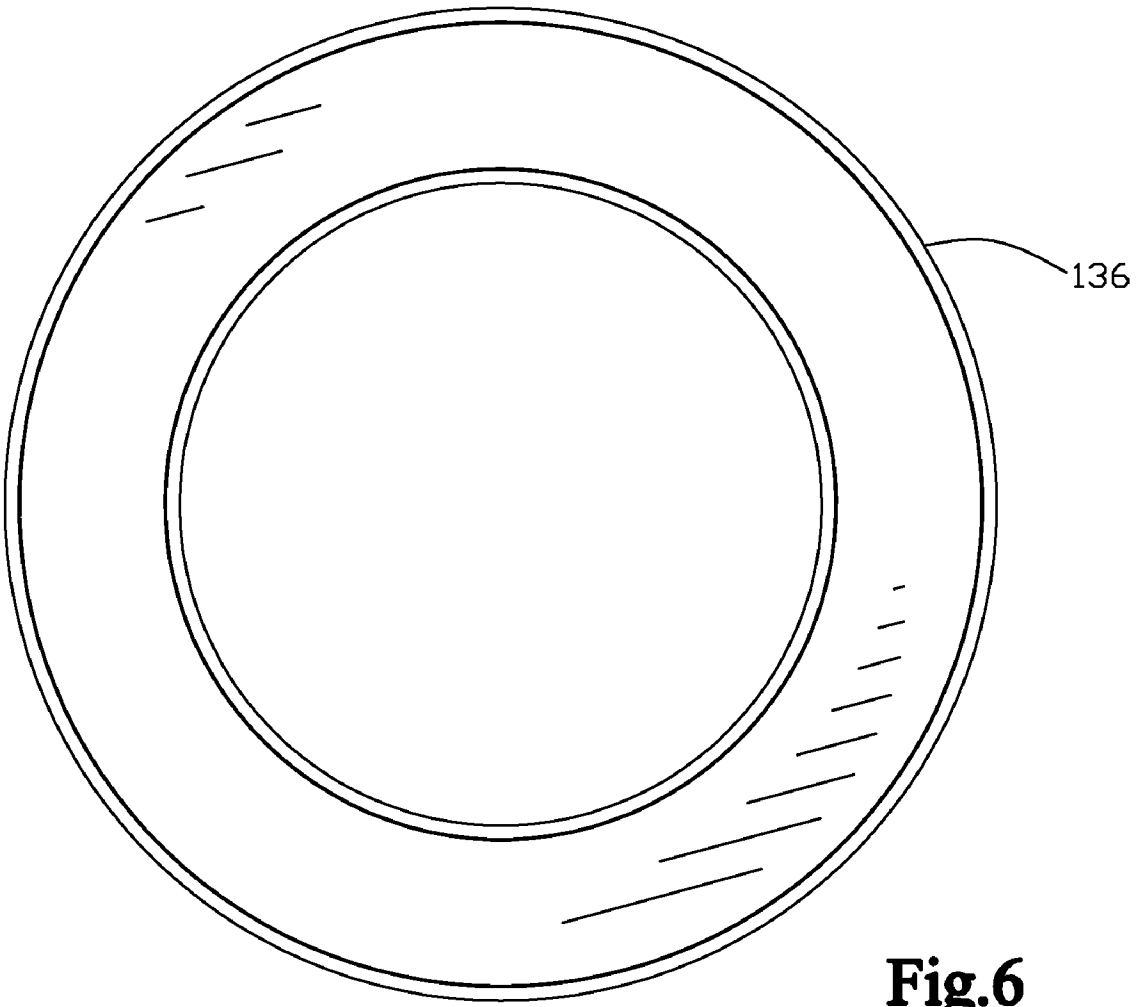
FIG. 6 shows an end view of the ring.

With initial reference to FIG. 1 shown is a side elevation view of the hook and ring game apparatus 30, wherein the ring 136 has passed through a pendulum type movement 144 on the tether 102 with the ring 136 engaged 160 on the hook 38 indicating a score. Continuing, FIG. 2 shows a side elevation view of the hook 38 adjacent to the surface 34 with particulars of the hook 38, such as the hook 38 selectable length extension 94, the hook radius 90, the hook arcuate section 66 through the arcuate sweep 70, and the hook cantilever portion 74. Further, FIG. 3 shows a side elevation view of a plurality of hooks 38 adjacent to the surface 34 somewhat similar to the single hook 38 in FIG. 2. Next, FIG. 4 shows an end view of the surface 34 with the plurality of hooks 38, basically being the end view of FIG. 3, continuing FIG. 5 shows a side elevation view of the tether extension assembly 102, and FIG. 6 shows an end view of the ring 136.

Figure 7:
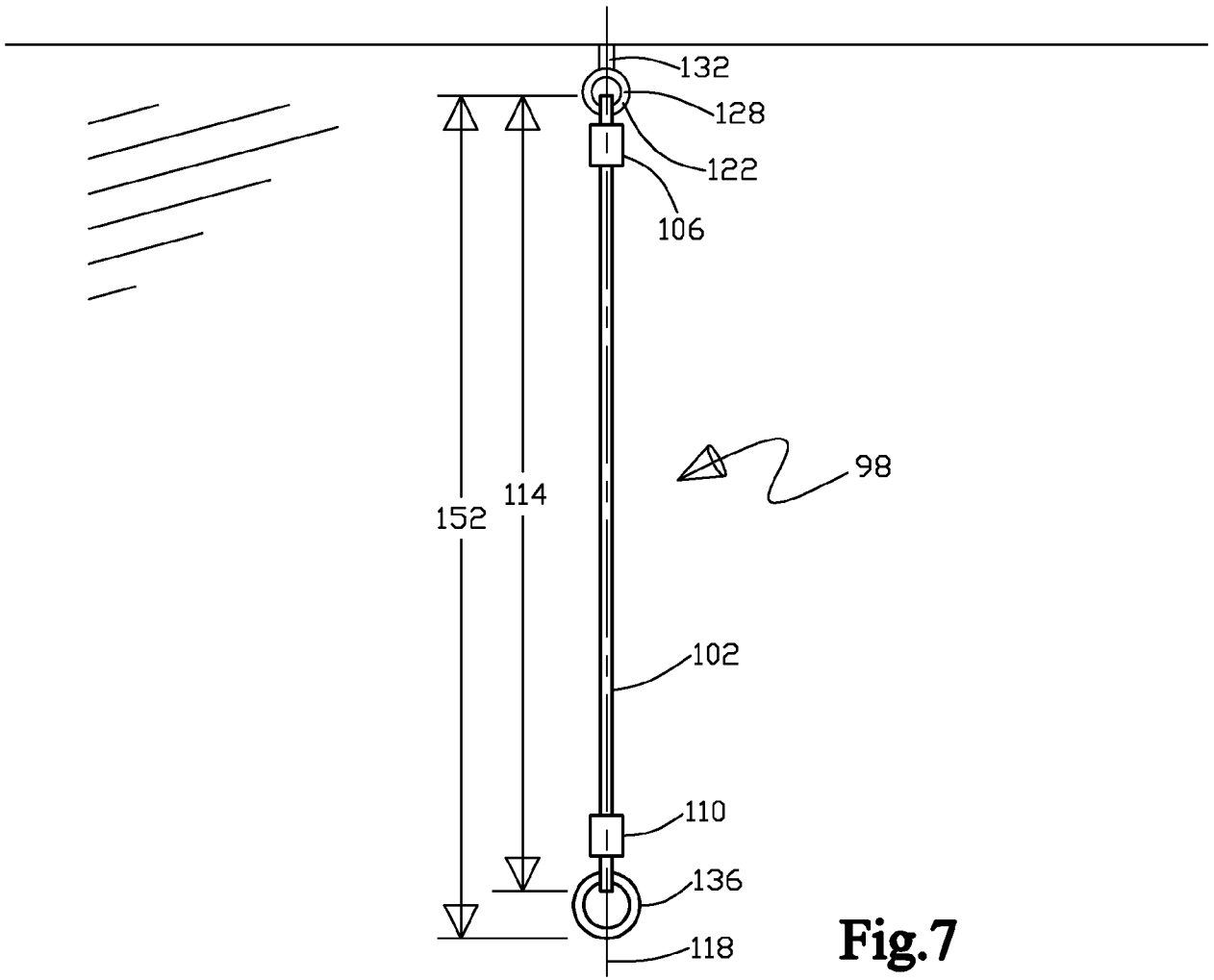
FIG. 7 shows a side elevation view of the tether with the ring on the free or second end portion and the tether freely suspended from the overhead support on the first end portion.
Figure 8:
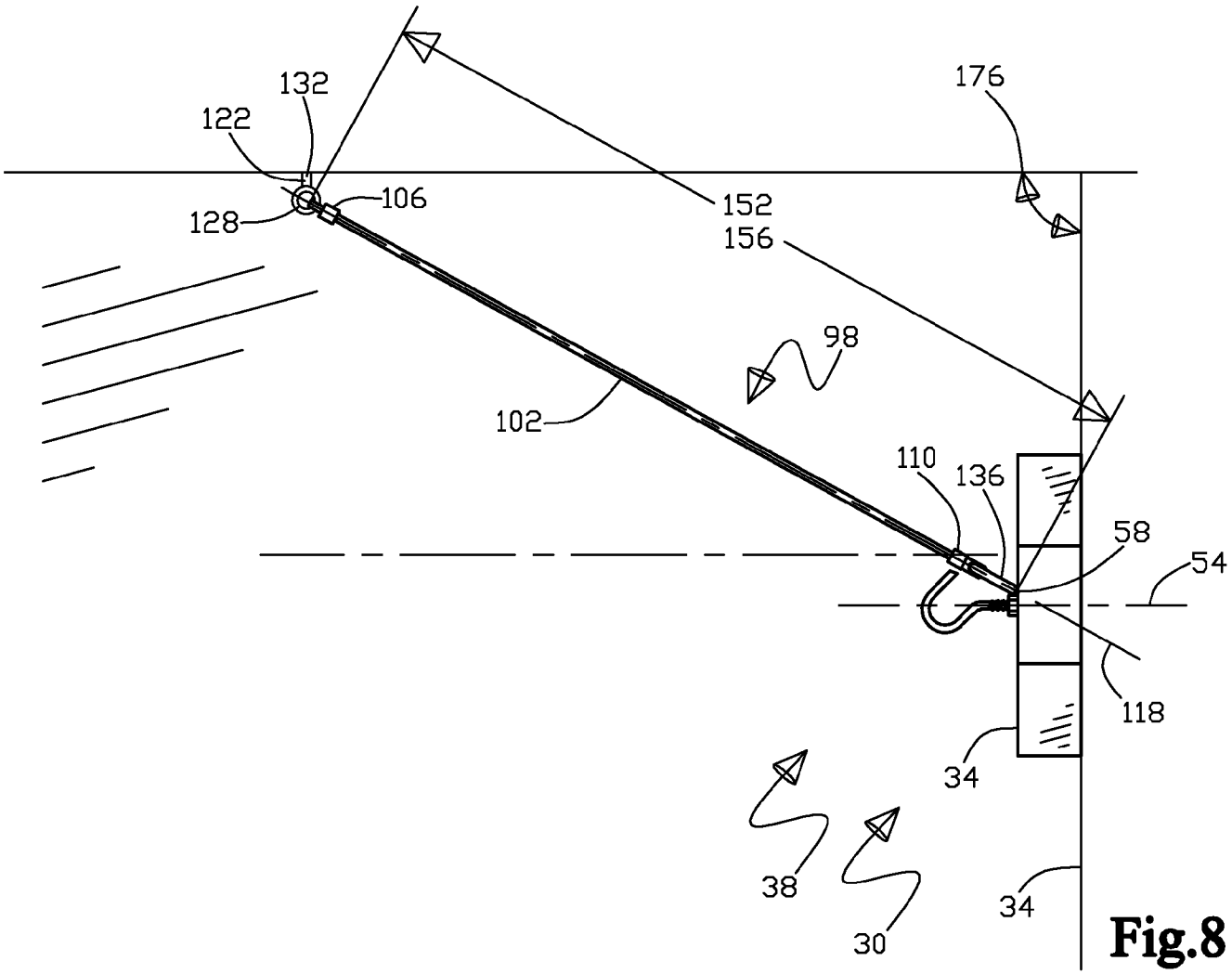
FIG. 8 shows a side elevation view of the hook and ring game apparatus in a pre play gauging measurement to set up the game for play utilizing the span from the hook to the overhead support set via the length of the tether first end portion and tether second end portion combined with the ring.
Figure 9:
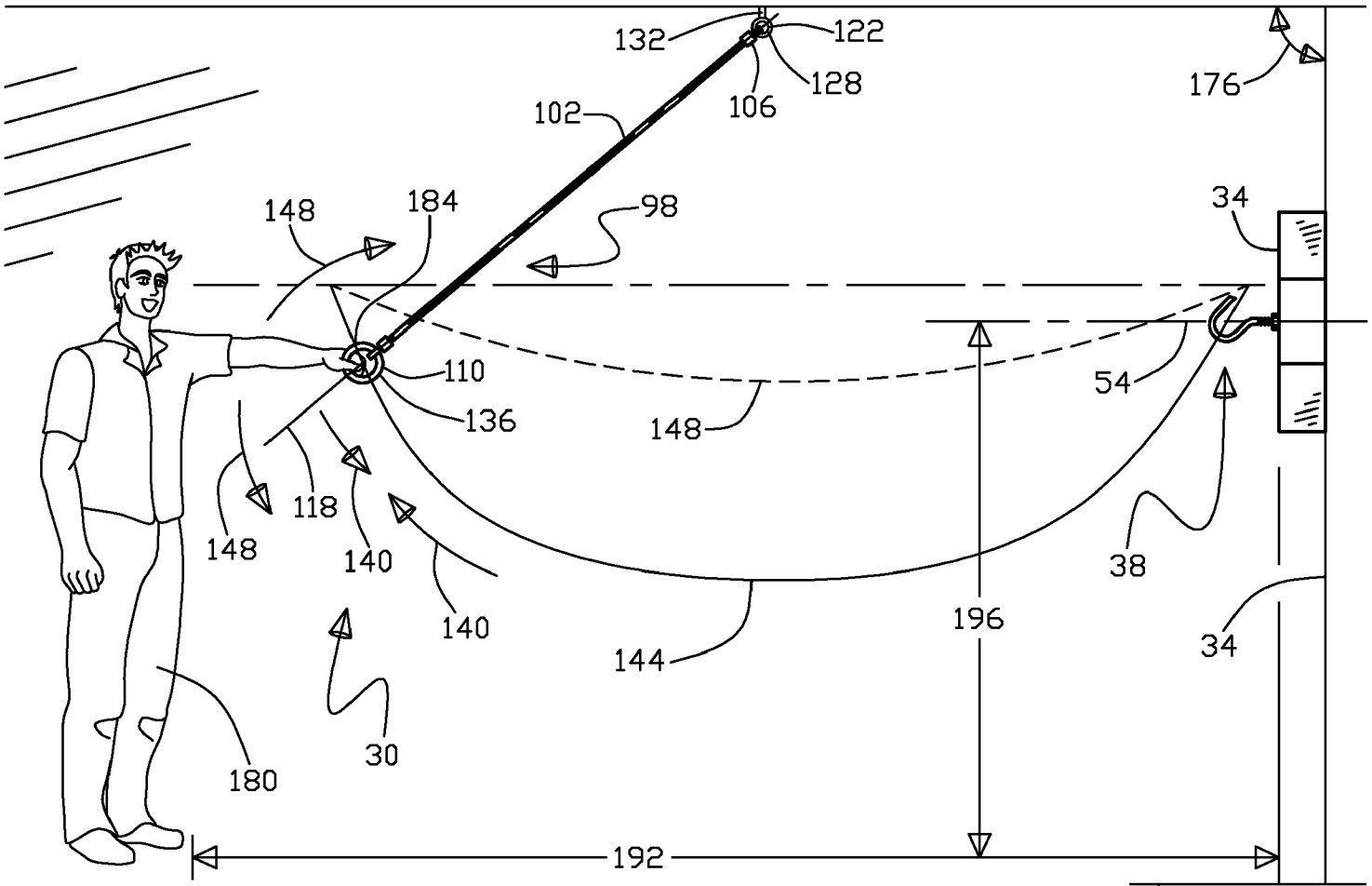
FIG. 9 shows a use drawing of the hook and ring game apparatus being played with a player initiating game play by either releasing or tossing the ring that is on the tether that is freely suspended from the overhead support, wherein the ring will substantially pass through a pendulum type of movement toward the area of the hook.

Moving onward, FIG. 7 shows a side elevation view of the tether 102 with the ring 136 on the free or second end portion 110 and the tether 102 freely suspended 122 from the overhead support 132 on the first end portion 106. Next, FIG. 8 shows a side elevation view of the hook and ring game apparatus 30 in a pre play gauging length 152 measurement 156 to set up the game for play utilizing the span 156 from the hook 38 to the overhead support 132 set via the length 152 of the tether first end portion 106 and tether second end portion 110 combined with the ring 136. Further, FIG. 9 shows a use drawing of the hook and ring game apparatus 30 being played with a player 180 initiating game play by either releasing 188 or tossing 188 the ring 136 that is on the tether 102 that is freely suspended 122 from the overhead support 132, wherein the ring 136 from the ring assembly 98 will substantially pass in a swinging 140 manner through a pendulum type of movement 144 or 148 toward the area of the hook 38.

Figure 10:
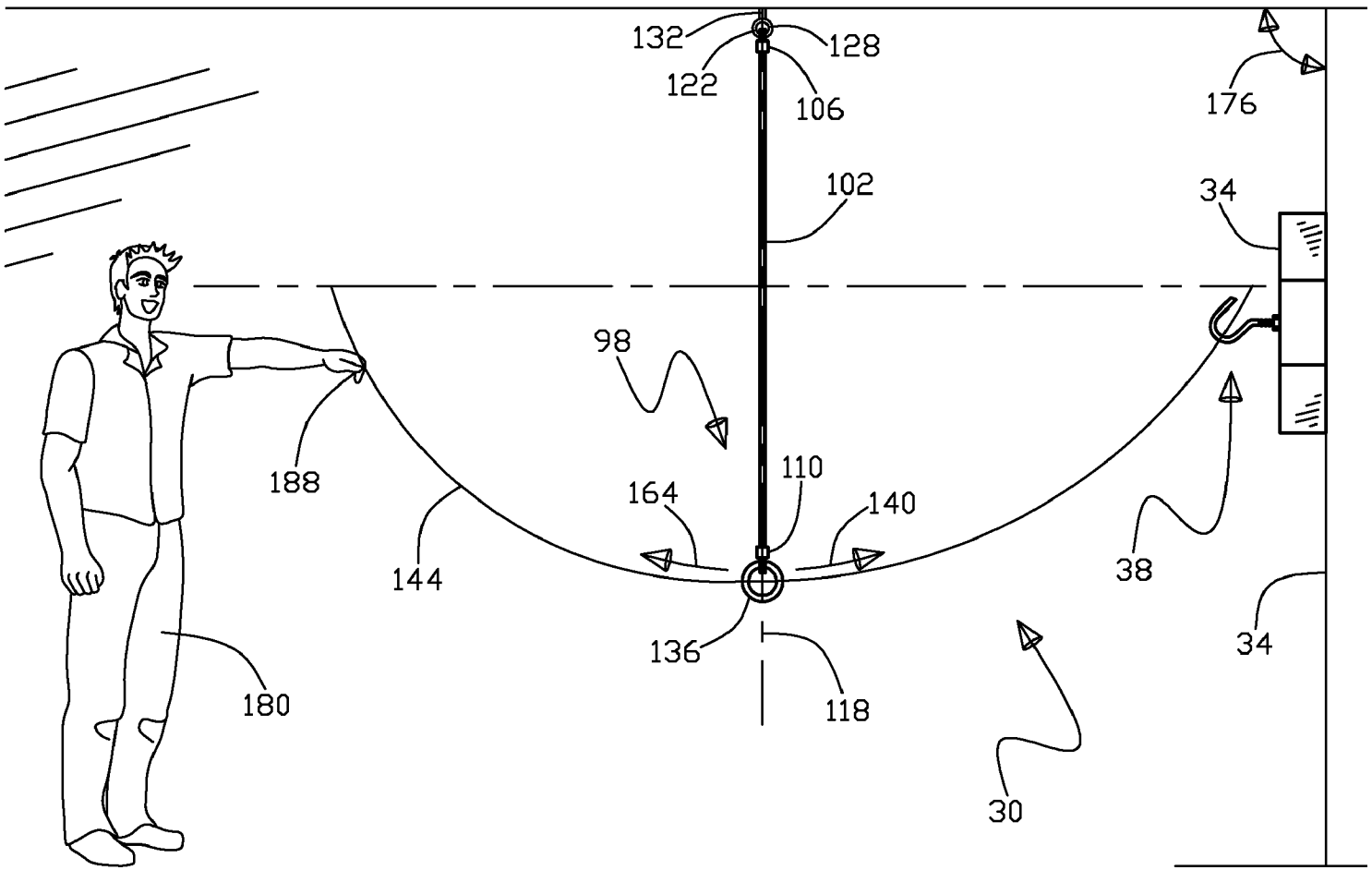
FIG. 10 shows a use drawing of the hook and ring game apparatus being played with a player in game play that has released or tossed the ring that is on the tether that is freely suspended from the overhead support, wherein the ring is substantially passing through the pendulum type of movement toward the area of the hook.
Figure 11:
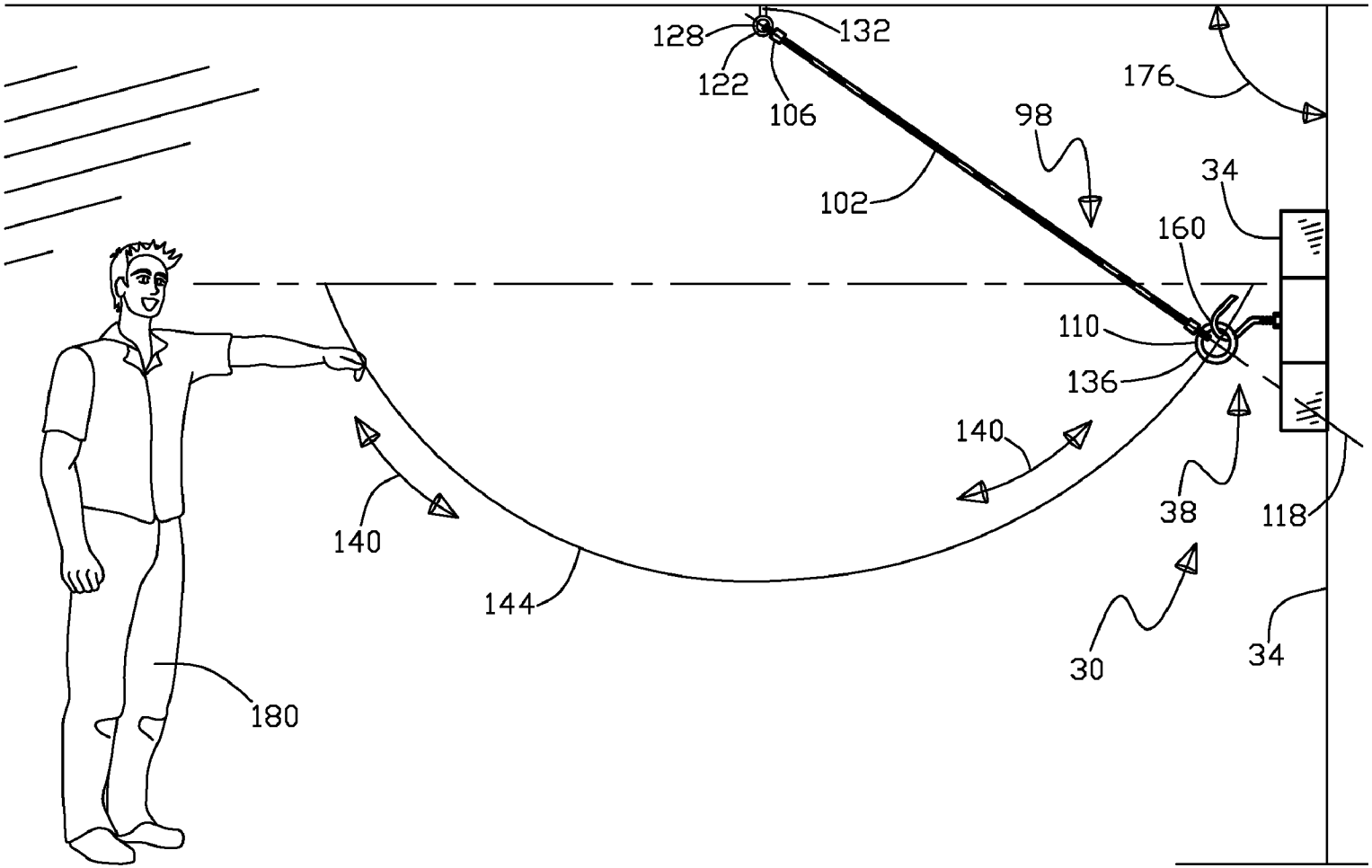
FIG. 11 shows a use drawing of the hook and ring game apparatus being played with a player in game play that has released or tossed the ring that is on the tether that is freely suspended from the overhead support, wherein the ring has engaged the hook for a score in the game.

Continuing, FIG. 10 shows a use drawing of the hook and ring game apparatus 30 being played with a player 180 in game play that has released 188 or tossed 188 the ring 136 that is on the tether 102 that is freely suspended 122 from the overhead support 132, wherein the ring 136 from the ring assembly 98 will substantially pass in a swinging 140 manner is substantially passing through the pendulum type of movement 144 or 148 toward the area of the hook 38. Yet further, FIG. 11 shows a use drawing of the hook and ring game apparatus 30 being played with a player 180 in game play that has released 188 or tossed 188 the ring 136 that is on the tether 102 that is freely suspended 122 from the overhead support 132, wherein the ring 136 has engaged 160 the hook 38 for a score in the game, thereby completing the pendulum type of movement 144 or 148 from the ring assembly 98 that substantially passed in a swinging 140 manner for the ring 136 to removably engage 160 the hook 38.

Broadly, in referring to FIGS. 1 through 8, the present invention of the hook and ring game apparatus 30 is disclosed that includes a hook device 38, as best seen in FIG. 2, with a mounting portion 42 having a proximal end portion 46 and a distal end portion 50 plus having a longitudinal axis 54 spanning there-between that is positioned substantially transverse 62 to the surface 34. Wherein the proximal end portion 46 is extending from the surface 34 forming a proximal end portion and surface interface 58. The hook device 38 again as best shown in FIG. 2, further includes an arcuate portion 66 extending from the distal end portion 50 wherein the arcuate portion 66 forms a sweep 70 of about one-hundred and eighty (180) degrees terminating in a cantilever beam 74 having a lengthwise axis 78. The cantilever beam 74 approximately extending to the distal end portion 50, wherein the lengthwise axis 78 forms an acute angle 82 in relation to the surface 34, wherein the acute angle 82 is adjacent to the surface interface 58.

Continuing, further included in the present invention of the hook and ring game apparatus 30 is the ring assembly 98, in looking at FIGS. 5, 6, and 7, has a flexible tether extension 102 with the first end portion 106 and the second end portion 110 resulting in a defined length 114 of the tether extension 102 there-between. The tether 102 having an extension axis 118, with the extension first end portion 106 being freely suspended 122 from a selected position 128 in an overhead support 132. The extension second end portion 110 is adjacent to a ring 136, with the ring assembly 98 being operational to freely swing 140 the ring 136 through a pendulum type 144 or 148 arc path of movement 140 relative to the overhead support 132, as best shown in FIGS. 7, 9, 10, and 11. With the pendulum type 144 movement being a more nearly vertical when viewed from the player's 180 perspective and pendulum type movement 148 has a more nearly horizontal or lateral movement from the player's 180 perspective, such that if the player 180 throws or releases 188 the ring 136 toward the floor 190, movement 144 will more likely occur and if the player 180 throws or releases 188 the ring 136 laterally, movement 148 will more likely occur, see FIG. 9, wherein it is the player's 180 discretion on whether to throw or release 188 the ring 136 either more vertically downward toward the floor 190 or more laterally. In referring in particular to FIG. 8, the overhead support 132 is placed in a selected position 128 such that the extension length 114 and ring 136 further define a greater combined ring assembly length 152 that spans 156 from the hook proximal portion and surface interface 58 to the selected position 128 of the overhead support 132. The ring and hook game apparatus 30 is operational to form a chance element to removably engage 160 one another being the ring 136 onto the hook 38, as best shown in FIGS. 1 and 11, as the ring 136 moves or swings 140 through the pendulum type arc path 144 and/or 148 potentially coming into contact with the hook 38, with the result of either the ring 136 removably engaging 160 the hook 38 or not engaging the hook 38, wherein the ring 136 will follow the arc path 144 and/or 148 in a substantially reverse 164 direction of movement 140.

Continuing, on the hook and ring game apparatus 30, the extension axis 118 has an operational angular relation 168 to the longitudinal axis 54 of between about negative ninety degrees (−90°) to positive ninety degrees (+90°), as best shown in FIG. 1, however, with the angular relation 168 being preferably between about zero degrees (0°) to positive ninety degrees (+90°). Further, on the hook and ring game apparatus 30 the ring assembly length 152 is in the range of preferably about two (2) feet to thirty (30) feet, as best shown in FIG. 7. Optionally, the hook and ring game apparatus 30 can further comprise a plurality of hook devices 38, positioned adjacent 172 to one another, as best shown in FIGS. 3 and 4. Alternatively, on the plurality of hook devices 38 they can be positioned to be substantially adjacent to one another to form a contiguous pattern 86, as shown in FIGS. 3 and 4, wherein the patterns can be in a single line as shown in FIGS. 3 and 4, or in a grid/matrix type of pattern, triangular, rectangular, or any other pattern that is used to provide scoring options for the chance element of the ring 136 and the hook 38 to removably engage 160 one another. Also, to further alter the chance element as previously described the hook device 38 can be modified by having an arcuate portion 66 radius 90 of a different length as best shown in FIG. 2 dimensionally and FIGS. 3 and 4 for showing different size radius 90 hook devices 38. Continuing in this same area of optionally altering the hook device 38 for varying the chance element as previously described, the mounting portion of the hook device 38 can include the selectable length 94 between the proximal portion 46 and the distal portion 50 that results in the arcuate portion 66 being in a selected position through varying the distance of length 94 from the surface 34 that is operational to selectably vary the chance element removable engagement 160 percentage of the ring 136 removably engaging 160 the hook device 38, as best shown in FIGS. 1, 2, and 11.

Methods of Use

Referring primarily to FIGS. 9 through 11 for the use of the method of playing with the hook and ring game apparatus 30, included are the steps of providing a hook and ring game apparatus 30 with a plurality of hook devices 38 each having a mounting portion 42 with a proximal end portion 46 and a distal end portion 50 with a longitudinal axis 54 spanning there-between that is positioned substantially transverse 62 to the surface 34. Wherein the proximal end portion 46 extends from the surface 34 forming a proximal portion 46 and surface 34 interface 58, each hook device 38 further including an arcuate portion 66 extending from the distal end portion 50 wherein the arcuate portion 66 forms a sweep 70 of about one-hundred and eighty (180) degrees terminating in a cantilever beam 74 having a lengthwise axis 78. For each hook device 38, each arcuate portion 66 having a radius 90 of a different length, each cantilever beam 74 approximately extending to the distal end portion 50, also the lengthwise axis 78 forms an acute angle 82 in relation to the surface 34, wherein the acute angle 82 is adjacent to the surface interface 58, see FIG. 2 for hook device 38 detail.

Further included in the hook and ring game apparatus 30, is a ring assembly 98 having a flexible tether extension 102 with a first end portion 106 and a second end portion 110 resulting in a defined length 114 of the tether extension 102 there-between. The tether extension 102 having an extension axis 118, the extension first end portion 106 is freely suspended 122 from a selected position 128 in an overhead support 132, the extension second end portion 110 is adjacent to a ring 136. The ring assembly 98 is operational to freely swing 140 the ring 136 through a pendulum type arc path of movement 144 relative to the overhead support 132. The overhead support 132 is placed in a selected position 128 such that the extension length 114 and ring 136 further define a greater combined ring assembly length 152 that spans 156 from the hook proximal portion 46 and surface 34 interface 58 to the selected position 128 of the overhead support 132, as shown in FIG. 8. Further, in referring to FIG. 1, and in particular to the angular relation 168 is preferably set at between about zero degrees (0°) to positive ninety degrees (+90°). As is shown in FIGS. 9, 10, and 11, optionally to depict a typical room with ceiling, wall, and floor, although room walls and ceiling are not necessary as the surface 34 and the overhead support 132 could be independently supported without the need for a ceiling or wall, however, in the referenced FIGS. 9, 10, and 11 a conventional wall, floor, and ceiling are shown in an associated angular relationship 176 between the wall and ceiling that is approximately perpendicular. The ring 136 and hook 38 are operational to form a chance element to removably engage 160 one another as the ring 136 moves 140 through the arc path 144 and/or 148 potentially coming into contact with the hook 38, with either the ring 136 removably engaging 160 the hook or not engaging the hook 38, wherein the ring 136 will follow the arc path 144 and/or 148 in a substantially reverse direction 164 of movement 140.

Continuing, a next step is in positioning a player 180 a selected distance 192 from the surface 34, as best shown in FIG. 9, note that the selected distance of the player 180 from the surface 34 only requires that as a condition that the player 180 be able to grasp 184 the ring 136 as shown in FIG. 9 as a subsequent step. Further, as shown in FIG. 10, the next step of releasing 188 the ring 136 by the player 180 generally toward the hook device 38 through the pendulum type 144 and/or 148 movement 140, also see FIG. 9. Next, in looking at FIG. 11, a step of scoring for the player 180 if the ring 136 engages 160 any one of the plurality of hooks 38, wherein the score is unique to each of the hooks 38.

Alternatively, on the method of playing a hook and ring game apparatus 30 wherein the steps of grasping 184, releasing 188, and scoring are sequentially repeated then further adding a step of cumulating the player's 180 score based upon the scoring reaching a selected minimum score to determine an end to the method of playing. Another option would be on the method of playing a hook and ring game apparatus 30 wherein the steps of grasping 184, releasing 188, and scoring are sequentially repeated for each of a plurality of players 180, wherein each player 180 is allowed a selected number of grasping 184 and releasing 188 cycles per a player's 180 turn based upon the player's 180 ability.

Continuing, optionally the method of playing the hook and ring game apparatus 30 can further add a step of cumulating each players 180 score and ending the method of playing based upon the scoring for a single player 180 reaching a selected minimum score. A further optional added step can be of an ending the method of playing based upon each player 180 having an equal number of turns and a highest scoring player 180 having a score at least a selected amount higher than the next highest scoring player 180. Another optional step is of matching the selected number of grasping 184 and releasing 188 cycles per the player's 180 turn for each player 180 and a highest scoring player 180 having a score at least a selected amount higher than the next highest scoring player 180.

The preferred rules for playing the hook and ring game apparatus 30 are as follows, however, deviations from these preferred rules would be acceptable for various scoring and game rules as desired to alter the ease or difficulty at which the game is played. Starting with the foul line where the player 180 is positioned at a distance 192 from the surface 34, wherein this foul line distance is set at about twelve feet, however, a distance more or less that twelve feet would be acceptable as long as the player 180 can grasp 184 the ring 136. The foul line distance only applies at the releasing 188 of the ring 136 by the player 180. A preferred clearance width for playing the game would be about four feet that is in a dimension transverse to distance 192. Further, the preferred height 196 of the hook 38 above the floor 190 is about fifty inches. The number of players 180 can be from a single player 180 to any number of players 180 to teams of players 180. Beginning players 180 can get five swings per turn with the more experienced players 180 getting three swings per turn. A score is defined when the ring 136 engages 160 the hook 38.

Further, in the preferred manner of game play for the hook and ring game apparatus 30, the game winner is the first to score fifteen points, with the winner having to win by at least two points in the case of multiple players 180. There is always an equal number of turns for each player 180 or team as the case may be. Thus, whichever player or team releases 188 secondly, they shall have the last turn in the game. If a player 180 or team reaches fifteen points and the opponent has a turn remaining, the player 180 or team reaching fifteen points first does not win unless the opponent scores zero on their last turn. In the case of team play only the next player 180 of the team gets the final turn, the entire team does not get a final turn. If the opponent scores three points or less on their final turn, the game continues until one player 180 or team is two or more points ahead after the final turn. During the turn where the first player 180 or team scores fifteen points, the number of swings that it took during that turn to reach fifteen points is counted and the opponent with the final turn gets only that number of swings. For instance, if the player 180 reaching fifteen points took two swings to reach fifteen points on the last turn, the opponent only gets two swings on the final turn. The game is written for using a single hook 38 wherein an engagement 160 of the ring 136 upon the hook 38 is a single point for scoring purposes. However, as follows in Tables 1 and 2 below, different size hooks 38 can include different radius 90 sizes and different lengths 94, that can alter the chance element percentages of removably engaging 160 as between the ring 136 and the hook 38 as best shown in FIG. 2 dimensionally and in FIGS. 3 and 4 using a plurality of hooks 38.

Referring in particular to FIG. 2, the following Table 1 values are the preferred dimensions of the hooks, all dimensions in inches;

TABLE 1

| | Radius 90 | Cantilever beam 74 length | Length 94 |
|---|---|---|---|
| Large hook 38 | 0.43 | 1.5 | 1.62 |
| Medium hook 38 | 0.35 | 0.87 | 1.06 |
| Small hook 38 | 0.25 | 0.62 | 0.87 |

Table 2 details out the chance element variance based upon empirical testing by varying the length 94, in inches, as shown in FIG. 2, with the percentages representing the percent engagement 160 of the ring 136 onto the hook 38, wherein three different individuals each made one-hundred throws or releases 188, as shown in FIGS. 9, 10, and 11, per percentage data point below, resulting in three-hundred throws 188 per percentage given, for a total of two-thousand seven-hundred data points for the entire test data;

TABLE 2

| | % (length 94) | % (length 94) | % (length 94) |
|---|---|---|---|
| Large hook 38 | 50 (2.375) | 52 (1.625) | 36 (0.75) |
| Medium hook 38 | 24 (1.56) | 26 (1.31) | 18 (1.06) |
| Small hook 38 | 24 (1.25) | 6 (0.87) | 2 (0.75) |

It can be observed from the data that generally the larger the hook, the higher the engagement 160 percentage of the ring 136 onto the hook 38, also generally the longer the length 94 the higher the engagement 160 percentage of the ring 136 onto the hook 38, thus these two axioms form the basis upon which to make the game harder or easier to play, depending upon the skill level or experience of the players 180. Furthermore, in using a combination of different size hooks 38 adjacent 86 to one another on the surface 34, as shown in FIGS. 3 and 4 for instance as previously described would enable differing chance element percentages to be sought after in playing the same game in going along with assigning different point values to the different size hooks 38, such as lower point values for the higher chance element percentages and higher point values for the lower chance element percentages. In addition, by varying the length 94 could also lead to different point levels awarded for engagement 160 with the longer lengths 94 having lower point vales as having a higher point values for shorter lengths 94. Another, even further option for altering the chance element percentages would be to have the plurality of hooks 38 arranged in different patterns, referring to FIGS. 3 and 4, as previously described, for instance in a grid matrix, triangular patterns, angles linear patterns, and the like.

CONCLUSION

Accordingly, the present invention of a hook and ring game apparatus 30 has been described with some degree of particularity directed to the embodiments of the present invention. However, the method of playing the hook and ring game apparatus 30 can have a number of modifications in scoring, and rules for play by mutual agreement of the players. It should be appreciated, though; that the present invention is defined by the following claims construed in light of the prior art so modifications and changes may be made to the exemplary embodiments of the present invention without departing from the inventive concepts contained therein.

The invention claimed is:

1. A hook and ring game apparatus, comprising:

(a) a hook device including a mounting portion with a proximal end portion and a distal end portion having a longitudinal axis spanning therebetween that is positioned substantially transverse to a surface, wherein said proximal end portion is extending from the surface forming a proximal end portion and surface interface, said hook device further including an arcuate portion extending from said distal end portion wherein said arcuate portion forms a sweep of about one-hundred and eighty (180) degrees, said arcuate portion having a radius, wherein said arcuate portion terminates in a cantilever beam having a lengthwise axis, said cantilever beam approximately extending to said distal end portion, said lengthwise axis forms an acute angle in relation to the surface, wherein said acute angle is adjacent to said surface interface, said mounting portion includes threads to positively lock a selectable length into a selected length between said proximal portion and said distal portion, wherein a ratio of said selected length to said radius equals in the range of three (3) to four (4) that results in maximizing a chance that said ring will engage said hook, wherein said selected length results in said arcuate portion being in a selected position from the surface; and (b) a ring assembly including a flexible tether extension having a first end portion and a second end portion resulting in a defined length of said tether extension therebetween, with said tether having an extension axis, said extension first end portion is freely suspended from a selected position in an overhead support, said extension second end portion is adjacent to a ring, said ring assembly is operational to freely swing said ring through a pendulum type arc path of movement relative to the overhead support, the overhead support is placed in a selected position such that said extension length and ring further define a greater combined ring assembly length that spans from said hook proximal portion and surface interface to said selected position of the overhead support, said ring and hook are operational to form a chance element to removably engage one another as said ring moves through said arc path potentially coming into contact with said hook, with either said ring removably engaging said hook or not engaging said hook, wherein said ring will follow said arc path in a substantially reverse direction.

2. A hook and ring game apparatus according to claim 1 wherein said extension axis has an operational angular relation to said longitudinal axis of between about negative ninety degrees (−90° ) to positive ninety degrees (+90° ).

3. A hook and ring game apparatus according to claim 1 wherein said ring assembly length is in the range of about two (2) feet to thirty (30) feet.

4. A hook and ring game apparatus, comprising:

(a) a plurality of hook devices, each including a mounting portion with a proximal end portion and a distal end portion having a longitudinal axis spanning therebetween that is positioned substantially transverse to a surface, wherein said proximal end portion is extending from the surface forming a proximal end portion and surface interface, each said hook device further including an arcuate portion extending from said distal end portion wherein said arcuate portion forms a sweep of about one-hundred and eighty (180) degrees, terminating in a cantilever beam having a lengthwise axis, each said arcuate portion having a radius of a different length, each said cantilever beam approximately extending to said distal end portion, each said lengthwise axis forms an acute angle in relation to the surface, wherein said acute angle is adjacent to said surface interface, each said mounting portion includes threads to positively lock a selectable length into a selected length between each said proximal portion and each said distal portion, wherein a ratio of each said selected length to each said radius equals in the range of three (3) to four (4) that results in maximizing a chance that said ring will engage each said hook, wherein each said selected length results in each said arcuate portion being in a selected position from the surface, further each said radius is in the range of a ratio of one point two (1.2) to one point four (1.4) times a next smaller adjacent radius, wherein said selected length to said radius ratios and said radius to said radius ratios establish an increased said ring to said hook engagement percentage in equal increments of about three for each adjacent hook increased radius size, wherein operationally game scoring can be proportioned to about triple points awarded for said ring to engage said hook as said hook radius decreases in relation to an adjacent hook radius size; and (b) a ring assembly including a flexible tether extension having a first end portion and a second end portion resulting in a defined length of said tether extension therebetween, with said tether having an extension axis, said extension first end portion is freely suspended from a selected position in an overhead support that is related approximately in a perpendicular manner to the surface, said extension second end portion is adjacent to a ring, said ring assembly is operational to freely swing said ring through a pendulum type arc path of movement relative to the overhead support, the overhead support is placed in a selected position such that said extension length and ring further define a greater combined ring assembly length that spans from said hook proximal portion and surface interface to said selected position of the overhead support, said ring and hook are operational to form a chance element to removably engage one another as said ring moves through said arc path potentially coming into contact with said hook, with either said ring removably engaging said hook or not engaging said hook, wherein said ring will follow said arc path in a reverse direction.

5. A hook and ring game apparatus according to claim 4 wherein said extension axis has an operational angular relation to said longitudinal axis of between about zero degrees (0° ) to positive ninety degrees (+90° ).

6. A hook and ring game apparatus according to claim 4 wherein said ring assembly length is in the range of about two (2) feet to thirty (30) feet.

7. A hook and ring game apparatus according to claim 4 wherein said plurality of hook devices are positioned substantially adjacent to one another to form a contiguous pattern.

* * * * *